US008859874B2

(12) United States Patent
Kuroki

(10) Patent No.: US 8,859,874 B2
(45) Date of Patent: Oct. 14, 2014

(54) COEFFICIENT MEASUREMENT APPARATUS, EFFECT IMPARTMENT APPARATUS, AND MUSICAL SOUND GENERATING APPARATUS

(75) Inventor: Ryuichiro Kuroki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 57 days.

(21) Appl. No.: 12/350,119

(22) Filed: Jan. 7, 2009

(65) Prior Publication Data

US 2009/0173218 A1 Jul. 9, 2009

(30) Foreign Application Priority Data

Jan. 7, 2008 (JP) ..... 2008-000440

(51) Int. Cl.
*G10H 1/06* (2006.01)
*G10H 3/18* (2006.01)

(52) U.S. Cl.
CPC ..... *G10H 3/186* (2013.01)
USPC ..... 84/629; 84/616; 84/623

(58) Field of Classification Search
USPC ..... 84/629
See application file for complete search history.

(56) References Cited

U.S. PATENT DOCUMENTS

| | | | | |
|---|---|---|---|---|
| 4,610,024 | A | 9/1986 | Schulhof | |
| 5,905,222 | A | 5/1999 | Yamada | |
| 6,909,041 | B2 * | 6/2005 | Ohta | 84/630 |
| 7,062,337 | B1 * | 6/2006 | Blesser | 700/94 |
| 7,279,631 | B2 * | 10/2007 | Celi et al. | 84/735 |
| 2003/0000370 | A1 | 1/2003 | Kuroki | |
| 2004/0025675 | A1 * | 2/2004 | Miyazaki et al. | 84/736 |
| 2006/0147050 | A1 * | 7/2006 | Geisler | 381/61 |

FOREIGN PATENT DOCUMENTS

| | | | |
|---|---|---|---|
| JP | 07-336792 | A | 12/1995 |
| JP | 10-133657 | A | 12/1995 |
| JP | 2003-015644 | | 1/2003 |
| JP | 2003-241752 | A | 8/2003 |
| JP | 2005-024997 | | 1/2005 |

OTHER PUBLICATIONS

European Search Report mailed May 4, 2009, for EP Application No. 09150010.8, five pages.
Notification of Reasons for Rejection mailed Jul. 3, 2012, for JP Patent Application No. 2008-000440, with English Translation, five pages.

* cited by examiner

*Primary Examiner* — Christopher Uhlir
(74) *Attorney, Agent, or Firm* — Morrison & Foerster LLP

(57) ABSTRACT

In a coefficient measurement apparatus, a line input terminal receives a pickup signal that is generated based on a string vibration of a musical instrument. A microphone input terminal receives a microphone signal acquired by a microphone that collects sounds of the musical instrument. An adaptive filter estimates a transfer function associated to resonance of the musical instrument and a transfer function of an acoustic space formed from the musical instrument to the microphone, generates an output signal by processing the pickup signal using the estimated transfer function, and updates the transfer function using a difference between the output signal and the microphone signal as a reference signal.

6 Claims, 2 Drawing Sheets

COEFFICIENT MEASUREMENT APPARATUS, EFFECT IMPARTMENT APPARATUS, AND MUSICAL SOUND GENERATING APPARATUS

BACKGROUND OF THE INVENTION

1. Technical Field of the Invention

The present invention relates to a coefficient measurement apparatus, an effect impartment apparatus, and a musical sound generating apparatus using the effect impartment apparatus which can fully and reliably reproduce resonance of an acoustic musical instrument.

2. Description of the Related Art

When a musical sound of an acoustic musical instrument is amplified for the sake of live play or the like, the sound of the musical instrument is generally collected by a microphone. However, when the musical sound of the acoustic musical instrument is received by the microphone, there is a problem in that howling easily occurs. Accordingly, in many cases, a piezoelectric pickup is used to pick up string vibrations and to output them as an audio signal.

However, using the piezoelectric pickup, it is not possible to sufficiently pick up a resonant sound of an acoustic musical instrument (for example, a body resonance of an acoustic guitar). Thus, it has been suggested that acoustic effects such as delay or reverb be imparted to reproduce the resonance sound (for example, see Patent Reference 1). It has also been suggested that an FIR filter be used to perform signal processing to reproduce an echo feeling (for example, see Patent Reference 2).

[Patent Reference 1] Japanese Patent Application Publication No. 2003-15644

[Patent Reference 2] Japanese Patent Application Publication No. 2005-24997

However, simply imparting acoustic effects such as delay or reverb as in Patent Reference 1 cannot reproduce a resonance feeling such as a box resonance of an acoustic musical instrument (specifically, emphasis or attenuation of a specific frequency).

When the FIR filter is used as in Patent Reference 2, there is a need to previously measure an impulse response. To measure an impulse response, an impulse hammer or vibrator is generally used to apply a vibration. However, measurement using the impulse hammer has a problem in that measurement variation is high, failing to achieve reliable measurement. Measurement using the vibrator also has a problem in that the measured resonance characteristics are different from those of actual play since the vibrator is brought into contact with the musical instrument.

SUMMARY OF THE INVENTION

Therefore, it is an object of the invention to provide a coefficient measurement apparatus, an effect impartment apparatus, and a musical sound generating apparatus using the effect impartment apparatus which can fully and reliably reproduce resonance of an acoustic musical instrument without the need to measure impulse responses.

A coefficient measurement apparatus according to the invention includes a line input terminal that receives a pickup signal that is generated based on a vibration of a musical instrument, a microphone input terminal that receives a microphone signal acquired by a microphone, and an adaptive filter that processes the pickup signal.

An effect impartment apparatus according to the invention includes a line input unit that receives a pickup signal that is generated based on a vibration of a musical instrument, a filter in which a transfer function previously estimated by the coefficient measurement apparatus is set, the filter generating an output signal by processing the pickup signal using the set transfer function, and an output unit that outputs the output signal.

The adaptive filter estimates a transfer function associated to resonance of the musical instrument and a transfer function of an acoustic space formed from the musical instrument to the microphone. The adaptive filter generates an output signal by processing the pickup signal using the estimated transfer function. The adaptive filter also updates the transfer function using a difference between the output signal and the microphone signal acquired by the microphone as a reference signal. The output signal approaches the microphone signal acquired by the microphone as the adaptive filter updates the transfer function each time. Therefore, the output signal includes a resonant sound or a reverberant sound.

The effect impartment apparatus, which includes the filter in which the transfer function estimated in the above manner has been set, can output an audio signal reproducing a resonant sound or a reverberant sound of the acoustic musical instrument and can also reproduce a resonance feeling such as a so-called box sound. In addition, since the pickup signal does not include noise of the acoustic space and feedback sound (i.e., an output signal generated after being amplified outside the coefficient measurement apparatus), the risk that the output signal is looped, causing howling, is low.

In the coefficient measurement apparatus according to the invention, the adaptive filter preferably includes a number of taps corresponding to a resonance time of the musical instrument. If the number of taps is large, the number of calculations of the adaptive filter is increased. In addition, a large number of taps compared to the actual body sounding time contributes to noise. If the number of taps is small, it is not possible to reproduce the body resonance. Therefore, it is preferable that the resonance time of an actual acoustic musical instrument be measured through experiments or the like or be set to an average body sounding time of a general acoustic guitar.

A musical sound generating apparatus according to the invention includes the effect impartment apparatus and a musical instrument equipped with a pickup that detects a vibration of a vibrating part of the musical instrument and generates a pickup signal, and an output unit that outputs the pickup signal, wherein the output unit is connected to the line input terminal of the effect impartment apparatus.

According to the invention, there is no need to measure impulse responses and it is possible to fully and reliably reproduce resonance of an acoustic musical instrument.

DETAILED DESCRIPTION OF THE INVENTION

Figure 1:
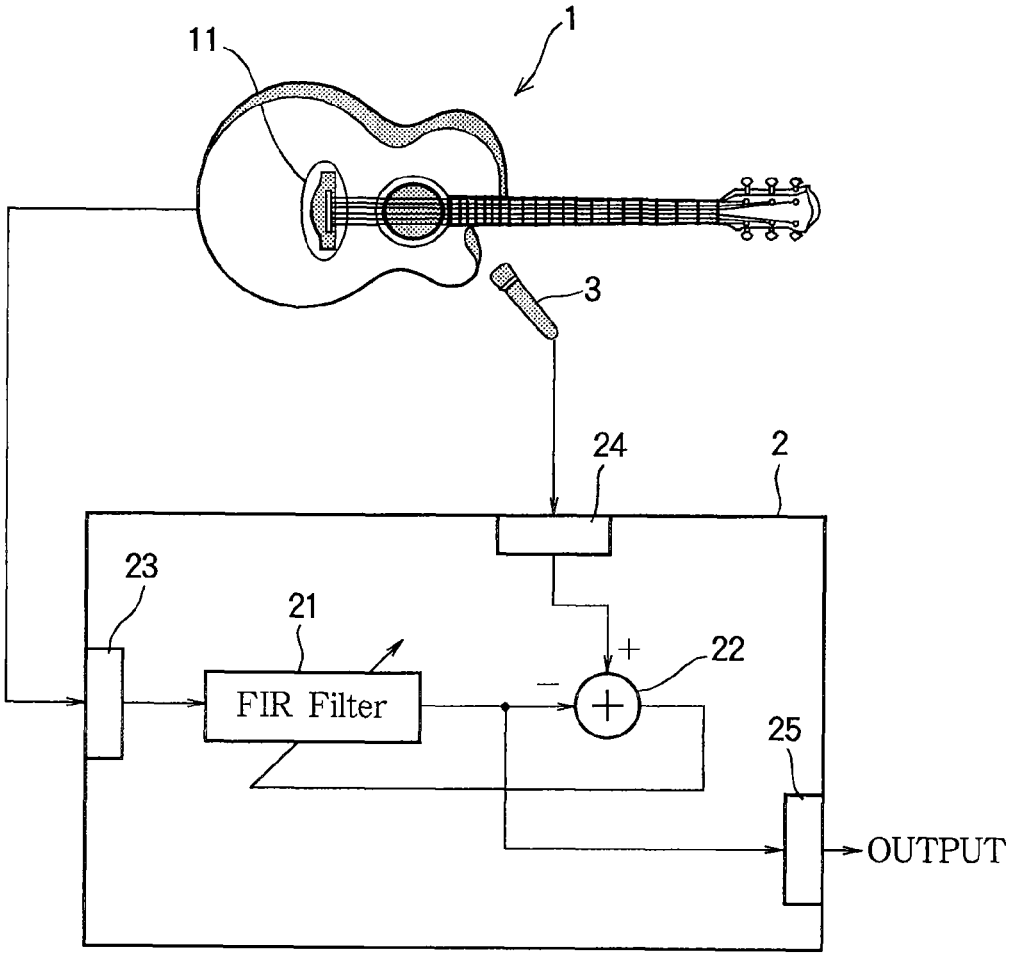
FIG. 1 illustrates the configurations of a guitar and a coefficient measurement apparatus.

A guitar, a coefficient measurement apparatus, and a resonance simulator (effect impartment apparatus) according to an embodiment of the invention will now be described. FIG. 1 illustrates configurations of the guitar and the coefficient measurement apparatus.

The guitar 1 is an electric acoustic guitar having a pickup 11. The pickup 11 is mounted on a bridge part of the guitar 1 to detect vibrations of the box and strings of the guitar 1 as an audio signal. The audio signal detected by the pickup 11 is amplified by an amplifier provided at a front end and is output through an output terminal (not shown). A magnetic pickup that detects vibrations through electromagnetic induction or a piezoelectric device that detects vibrations through piezoelectric effects is used as the pickup 11.

The coefficient measurement apparatus 2 includes an FIR filter 21, an adder 22, a line input terminal 23, a microphone input terminal 24, and an output terminal 25. The audio signal output through the output terminal of the guitar 1 is input to the line input terminal 23. The input audio signal is converted into a digital audio signal through A/D conversion and the digital audio signal is then input to the FIR filter 21.

A microphone 3 is connected to the microphone input terminal 24. A microphone signal (analog audio signal) collected by the microphone 3 is input to the microphone input terminal 24. The microphone signal input to the microphone input terminal 24 is converted into a digital audio signal through A/D conversion and the digital audio signal is then input to the adder 22. In this embodiment, the microphone 3 receives a musical sound generated by the guitar 1.

The FIR filter 21 is a finite-length adaptive filter that simulates a transfer function of an acoustic path that is formed from the guitar 1 to the microphone 3 and simulates a transfer function associated to resonance of the musical instrument 1 and also filters the audio signal detected by the pickup 11.

Figure 2:
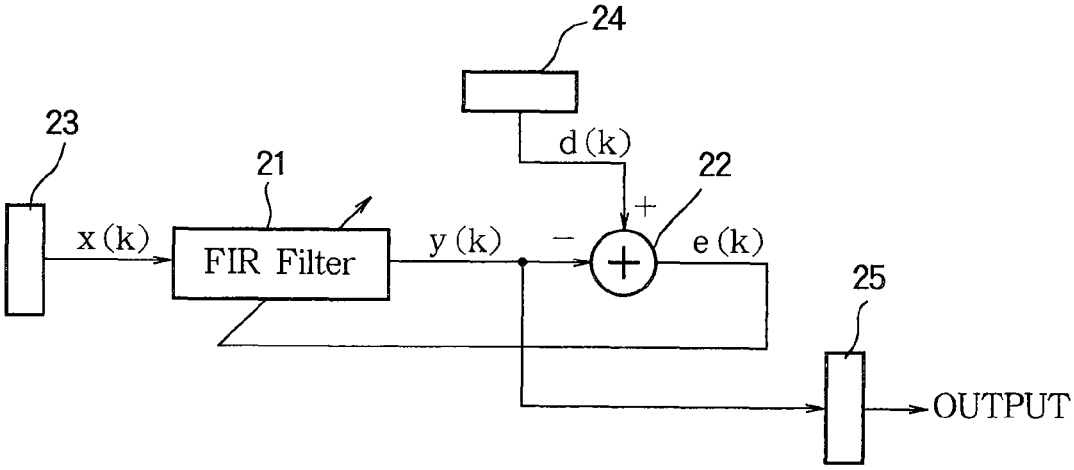
FIG. 2 is a block diagram illustrating a signal processing system of the coefficient measurement apparatus.

FIG. 2 is a block diagram illustrating a signal processing system of the coefficient measurement apparatus 2. All audio signals shown in FIG. 2 are digital. As shown in FIG. 2, an audio signal detected by the pickup 11 is input as an input signal x(k) to the FIR filter 21. The FIR filter 21 filters the input signal x(k) and generates an output signal y(k). The output signal y(k) is a signal simulating a sound that reaches the microphone 3 from the guitar 1, since filter coefficients of the FIR filter 21 simulate the transfer function of the acoustic path as described above. The output signal y(k) is output from the coefficient measurement apparatus 2 through the output terminal 25. The output signal y(k) output from the coefficient measurement apparatus 2 is provided, for example, to a sound system including an amplifier and a speaker, which generates a sound corresponding to the output signal y(k). When the coefficient measurement apparatus 2 is used only to estimate filter coefficients, the output terminal 25 is unnecessary and the configurations for outputting the output signal y(k) from the coefficient measurement apparatus 2 is also unnecessary.

A microphone signal (target signal) d(k) is input to the adder 22. The adder 22 subtracts the output signal y(k) from the target signal d(k) and outputs an error signal e(k). The error signal e(k) is input to the FIR filter 21. The error signal e(k) is used as a reference signal for updating the filter coefficients of the FIR filter 21. That is, the FIR filter 21 gradually updates the filter coefficients based on the target signal d(k) and the error signal e(k) so that the filter coefficients match the transfer function of the acoustic path formed from the guitar 1 to the microphone 3. The FIR filter 21 may stop updating the filter coefficients when the filter coefficients converge to a certain extent. Stopping the updating removes the risk that the filter coefficients will be changed to filter coefficients which easily cause howling. In addition, it is possible to implement a resonance simulator including a filter unit in which the filter coefficients that have converged to a certain extent are set (see FIG. 3).

A predetermined adaptive algorithm is used to update the filter coefficients. For example, a Least Mean Square (LMS) algorithm is used. Through calculation, the LMS algorithm estimates filter coefficients that minimize a square mean value J of the error signal e(k) (J=E[e(k)^2]) where E [•] represents an expected value. Of course, a different adaptive algorithm may also be used or the algorithm may be changed depending on the musical instrument that reproduces resonance.

The number of taps is set in the FIR filter 21 based on a body sounding time of the acoustic guitar. The body sounding time of the acoustic guitar may be measured through experiments or the like or may be set to a body sounding time of a general acoustic guitar (for example, about tens of milliseconds). If the number of taps is large, the number of calculations of the FIR filter 21 is increased. In addition, a large number of taps compared to the actual body sounding time may contribute to noise. If the number of taps is small, it is not possible to reproduce the body resonance of the guitar 1. Therefore, it is preferable that the body sounding time of the guitar 1 be previously measured and the number of taps be set to suit the measured time. The user may also be allowed to manually change the number of taps. In this case, a user interface for changing the setting may be provided on the coefficient measurement apparatus 2.

Here, since the input signal x(k) is an audio signal detected by the pickup 11, it mainly detects string vibrations rather than the body resonance of the guitar 1. On the other hand, the target signal d(k) detects an actual musical sound of the guitar 1 (i.e., a sound actually generated by the guitar 1) and also includes a resonant sound or a reverberant sound since it is a signal received by the microphone 3. The output signal y(k) reproduces the resonant sound or reverberant sound since it simulates the target signal d(k) and approaches the target signal each time the FIR filter 21 is updated.

Therefore, the coefficient measurement apparatus 2 can estimate the transfer function of the acoustic path and the transfer function based on the resonance of the musical instrument and can output a signal reproducing the resonant sound or reverberant sound of the guitar 1 and also can reproduce a resonance feeling such as a so-called box sound. In addition, since the actual musical sound received on the spot is used as the target signal, the coefficient measurement apparatus 2 can also reproduce changes of sound of the musical instrument with age. Further, since the pickup 11 does not receive noise of the acoustic space and feedback sound (i.e., an output signal generated after being amplified outside the coefficient measurement apparatus 2), there is no risk that the output signal y(k) is looped, causing howling.

Figure 3:
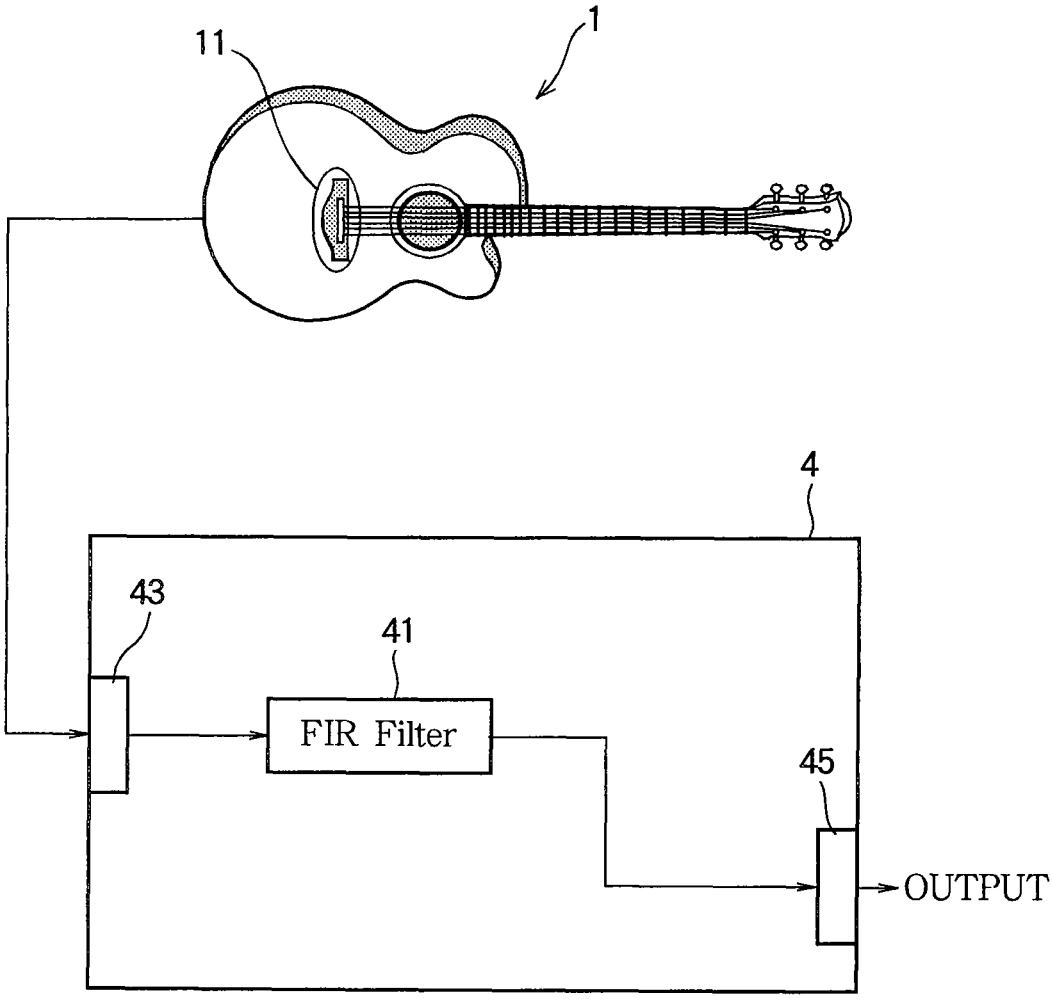
FIG. 3 illustrates the configurations of a guitar and a resonance simulator.

A resonance simulator using a transfer function estimated by the coefficient measurement apparatus 2 will now be described. FIG. 3 is a block diagram illustrating the configuration of the resonance simulator 4. Elements similar to those of FIG. 1 are denoted by like reference numerals and a description thereof will be omitted.

The resonance simulator 4 includes an FIR filter 41, a line input terminal 43, and an output terminal 45. The audio signal output through the output terminal of the guitar 1 is input to the line input terminal 43. The input audio signal is converted into a digital audio signal through A/D conversion and the digital audio signal is then input to the output terminal 45. A transfer function estimated by the coefficient measurement apparatus 2 is preset in the FIR filter 41. Accordingly, the FIR filter 41 can generate an output signal reproducing a resonant sound or a reverberant sound of the guitar 1 by filtering the audio signal input from the line input terminal 43. The output signal generated by the FIR filter 41 is output from the resonance simulator 4 through the output terminal 45. The output signal is then provided, for example, to a sound system including an amplifier and a speaker, which generates a sound corresponding to the output signal.

Since the resonance simulator 4 includes the FIR filter in which the transfer function estimated by the coefficient measurement apparatus 2 has been set, it is possible to output an audio signal reproducing the resonant sound or reverberant sound simply by inputting a pickup signal of the electric acoustic guitar to the resonance simulator 4. The resonance simulator 4 is an effect impartment apparatus for imparting acoustic effects to pickup signal of the guitar 1. The guitar with the effect impartment apparatus constitutes an music sound generating apparatus for generating music sounds based on vibration picked up from the guitar.

Although the guitar 1 is exemplified by the electric acoustic guitar in this embodiment, the resonance simulator may also be used when the guitar 1 is a normal acoustic guitar. In this case, a pickup may be attached to the acoustic guitar and a signal received by the pickup may be input to the line input terminal 23 (or the line input terminal 43).

Although the musical instrument for body resonance simulation is exemplified by the guitar in this embodiment, body resonance of another acoustic musical instrument may also be simulated. In such a case, the musical instrument includes a pickup that detects a vibration of a vibrating part of the musical instrument and generates a pickup signal.

A different effector such as delay or reverb may be provided downstream of the adder 22 in the coefficient measurement apparatus 2 to perform additional signal processing on the output signal. For example, this is suitable for use when the user wishes to emphasize a reverberant sound.

The invention claimed is:

1. A coefficient measurement apparatus comprising:

a line input terminal that receives a pickup signal that is generated based on a vibration of a musical instrument;

a microphone input terminal that receives a microphone signal acquired by a microphone that collects sounds of the musical instrument; and an adaptive filter that estimates a transfer function associated with resonance of the musical instrument and an acoustic space formed from the musical instrument to the microphone by generating an output signal by processing the pickup signal using the filter coefficients, outputting a reference signal based on a difference between the output signal and the microphone signal; and being capable of continuously updating the filter coefficients using the reference signal to cause the output signal to approach the microphone signal.

2. The coefficient measurement apparatus according to claim 1, wherein the adaptive filter includes a number of taps corresponding to a resonance time of the musical instrument.

3. An effect impartment apparatus comprising:

a line input unit that receives a pickup signal that is generated based on a vibration of a musical instrument;

a filter that is set with a transfer function previously estimated by a coefficient measurement apparatus and that generates an output signal by processing the pickup signal using the transfer function; and an output unit that outputs the output signal, wherein the coefficient measurement apparatus comprises:

a line input terminal that receives a pickup signal that is generated based on a vibration of the musical instrument;

a microphone input terminal that receives a microphone signal acquired by a microphone that collects sounds of the musical instrument; and an adaptive filter that estimates a transfer function associated with resonance of the musical instrument and an acoustic space formed from the musical instrument to the microphone by, generating an output signal by processing the pickup signal using the filter coefficients, outputting a reference signal based on a difference between the output signal and the microphone signal; and being capable of continuously updating the filter coefficients using the reference signal to cause the output signal to approach the microphone signal.

4. A musical sound generating apparatus comprising:

a musical instrument including a pickup that detects a vibration of a vibrating part of the musical instrument and generates a pickup signal, and an output terminal that outputs the pickup signal; and an effect impartment apparatus that applies an effect to the pickup signal, wherein the effect impartment apparatus comprises:

a line input unit that is connected to the output terminal of the musical instrument for receiving therefrom the pickup signal;

a filter that is set with a transfer function previously estimated by a coefficient measurement apparatus and that generates an output signal by processing the pickup signal using the transfer function; and an output unit that outputs the output signal, wherein the coefficient measurement apparatus comprises:

a line input terminal that receives the pickup signal that is generated based on the vibration of the musical instrument;

a microphone input terminal that receives a microphone signal acquired by a microphone that collects sounds of the musical instrument; and an adaptive filter that estimates a transfer function associated with resonance of the musical instrument and an acoustic space formed from the musical instrument to the microphone by generating an output signal by processing the pickup signal using the filter coefficients, outputting a reference signal based on a difference between the output signal and the microphone signal; and being capable of continuously updating the filter coefficients using the reference signal to cause the output signal to approach the microphone signal.

5. A coefficient measurement apparatus comprising:

a line input terminal that receives a pickup signal that is generated based on a vibration of a musical instrument;

a microphone input terminal that receives a microphone signal acquired by a microphone that collects sound of the musical instrument;

an FIR filter that generates an output signal by processing the pickup signal using filter coefficients;

an adder that outputs a reference signal based on a difference between the output signal and the microphone signal; and a calculation part that is capable of continuously updating the filter coefficients, using the reference signal, to cause the output signal to approach the microphone signal, so as to estimate a transfer function associated with resonance of the musical instrument and an acoustic space formed from the musical instrument to the microphone.

6. A coefficient measurement apparatus comprising:

a line input terminal that receives a pickup signal that is generated based on a vibration of a musical instrument;

a microphone input terminal that receives a microphone signal acquired by a microphone that collects sounds of the musical instrument;

an FIR filter that generates an output signal by processing the pickup signal using a transfer function associated-with resonance of the musical instrument and an acoustic space formed from the musical instrument to the microphone;

an adder that outputs a reference signal based on a difference between the output signal and the microphone signal; and a calculation part that is capable of continuously updating filter coefficients using the reference signal to cause the output signal to approach the microphone signal.

* * * * *